US011654438B2

(12) United States Patent
Balvanz

(10) Patent No.: US 11,654,438 B2
(45) Date of Patent: May 23, 2023

(54) WINGED HAMMER TIP

(71) Applicant: BELLOTA AGRISOLUTIONS AND TOOLS USA, LLC, Rock Island, IL (US)

(72) Inventor: Loran R. Balvanz, Bradenton, FL (US)

(73) Assignee: Bellota Agrisolutions and Tools USA, LLC, Rock Island, IL (US)

( * ) Notice: Subject to any disclaimer, the term of this patent is extended or adjusted under 35 U.S.C. 154(b) by 293 days.

(21) Appl. No.: 17/027,178

(22) Filed: Sep. 21, 2020

(65) Prior Publication Data

US 2021/0001346 A1 Jan. 7, 2021

Related U.S. Application Data

(63) Continuation-in-part of application No. 14/708,945, filed on May 11, 2015, now Pat. No. 10,780,441.

(60) Provisional application No. 61/993,335, filed on May 15, 2014.

(51) Int. Cl.
*B02C 13/28* (2006.01)

(52) U.S. Cl.
CPC ..... *B02C 13/2804* (2013.01); *B02C 2210/02* (2013.01)

(58) Field of Classification Search
CPC ..... B02C 13/2804; B02C 13/28
USPC ..... 241/300, 294
See application file for complete search history.

(56) References Cited

U.S. PATENT DOCUMENTS 4,871,119 A 10/1989 Murata
5,967,436 A 10/1999 Balvanz et al.
6,131,838 A 10/2000 Balvanz et al.
6,364,227 B1 4/2002 Dorscht
6,419,173 B2 7/2002 Balvanz et al.
6,481,654 B1 11/2002 Balvanz et al.
6,494,393 B1 12/2002 Berselli et al.
6,494,394 B1 * 12/2002 Balvanz ..... B02C 13/2804 241/300
6,622,951 B1 * 9/2003 Recker ..... B02C 13/2804 241/300
6,971,598 B2 12/2005 Schillinger et al.
7,055,770 B2 6/2006 Bardos
(Continued)

FOREIGN PATENT DOCUMENTS

CN 108452893 A 8/2018
DE 10223887 A1 12/2003
WO 2017174629 A1 10/2017

*Primary Examiner* — Faye Francis

(74) *Attorney, Agent, or Firm* — Levenfeld Pearlstein, LLC

(57) ABSTRACT

A hammer tip for releasable integration with a hammer, used in a size reducing machine. The hammer tip is separated into a production block with a top working edge and a spacer block. The production block and spacer block utilize a saddle back attachment to the hammer. The production block is further supported with a lock ledge integration to the spacer block. The spacer block further includes a pair of wings extending outwardly from the left and right sides, and forwardly from the front side, of the spacer block to form additional cutting edges. The wings provide for additional sizing of the material being ground and help move (or push or carry) more material through the grates of the size reducing machine in the same amount of time as compared to spacer blocks without wings. This increased throughput improves efficiency of the size reducing machine.

12 Claims, 20 Drawing Sheets

(56) References Cited

U.S. PATENT DOCUMENTS

Figure 1:
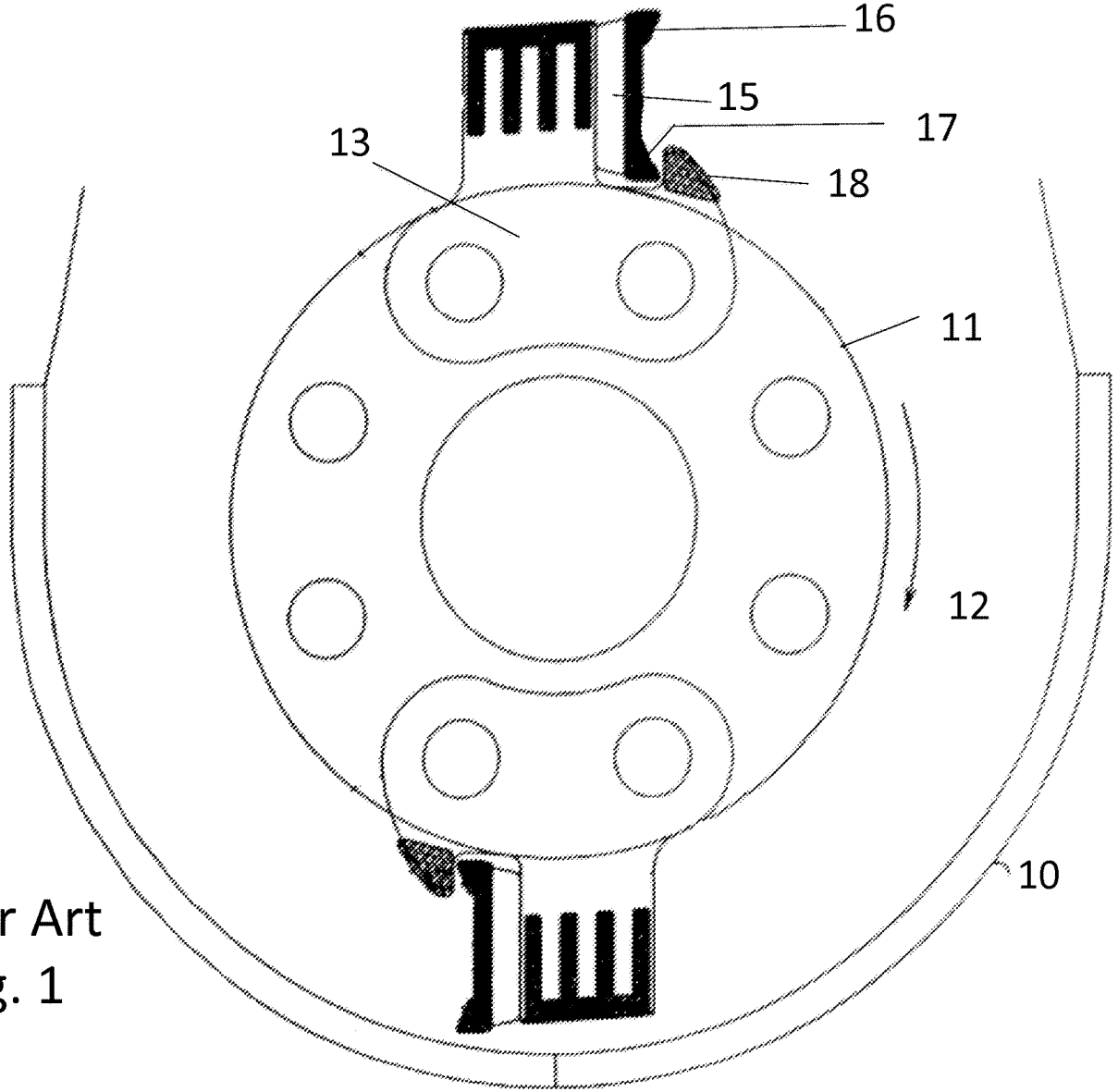
Prior Art Fig. 1

| | | | | |
|---|---|---|---|---|
| 7,494,080 | B2 * | 2/2009 | Knotts | B02C 13/2804 241/300 |
| 7,959,098 | B2 | 6/2011 | Doppstadt | |
| 8,113,453 | B2 | 2/2012 | Bardos | |
| 8,857,748 | B2 | 10/2014 | Carson et al. | |
| 2006/0196982 | A1 * | 9/2006 | Davis | B02C 13/2804 241/294 |
| 2006/0226270 | A1 | 10/2006 | Kammerer | |
| 2012/0248231 | A1 | 10/2012 | Fredsall | |
| 2013/0277476 | A1 | 10/2013 | Doppstadt et al. | |

* cited by examiner

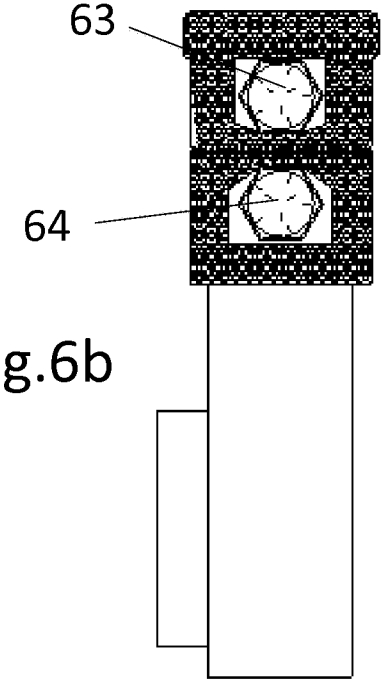
Fig.6b
Fig. 6c
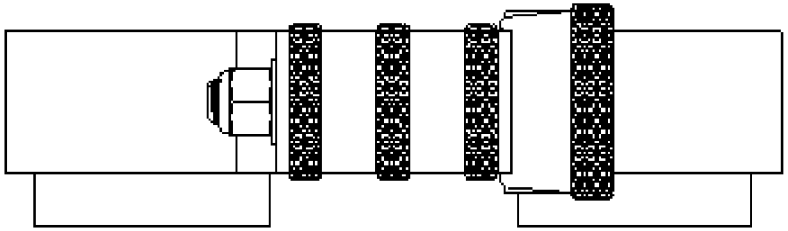
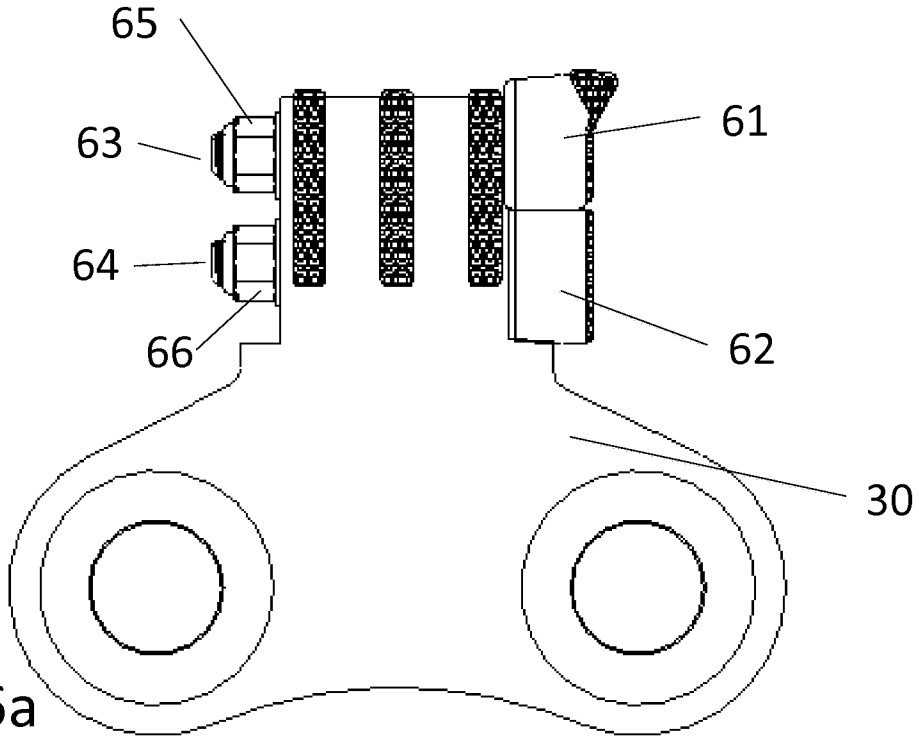
Fig. 6a

Fig. 7c
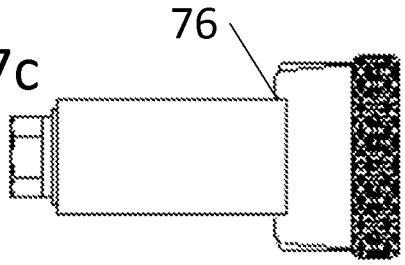
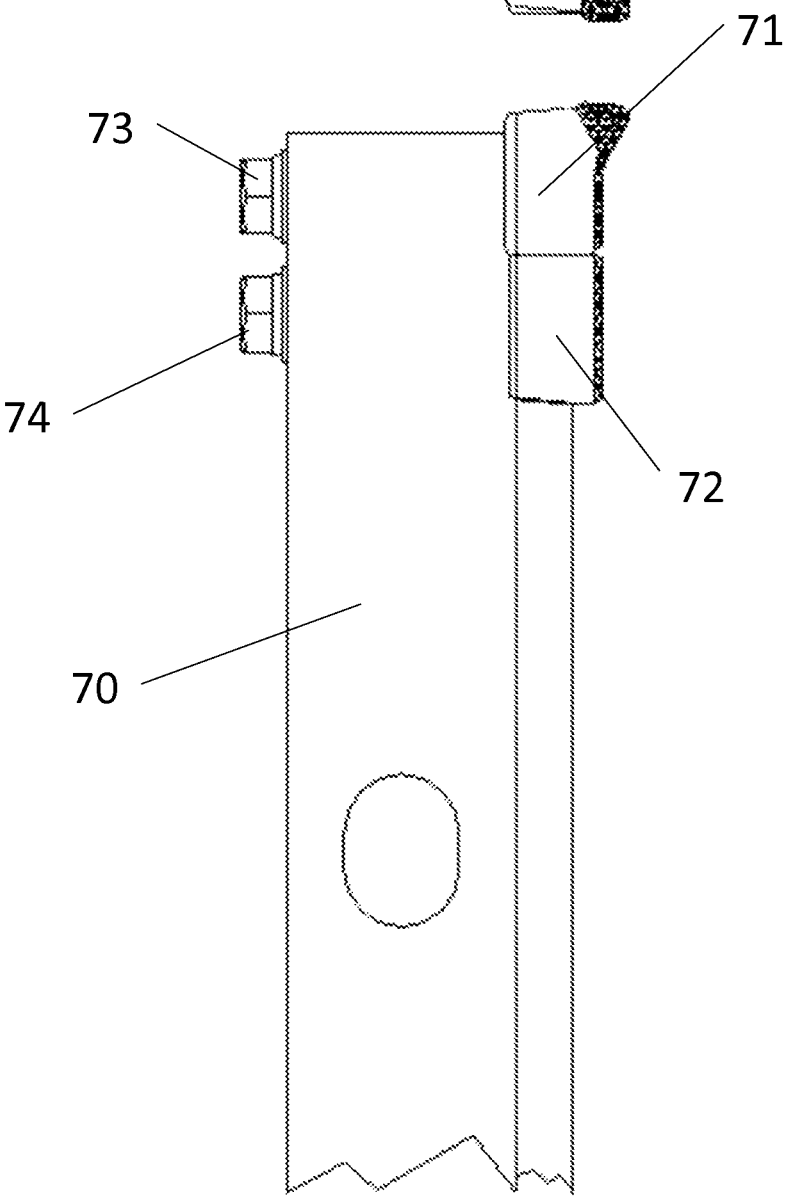
Fig. 7a
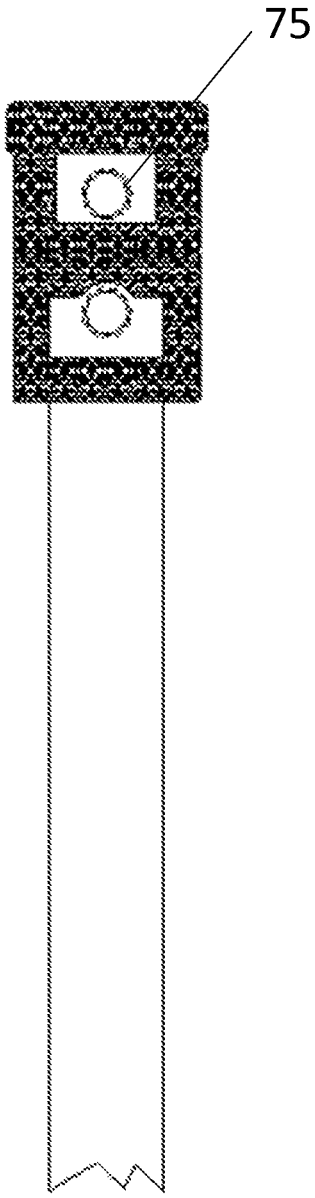
Fig. 7b

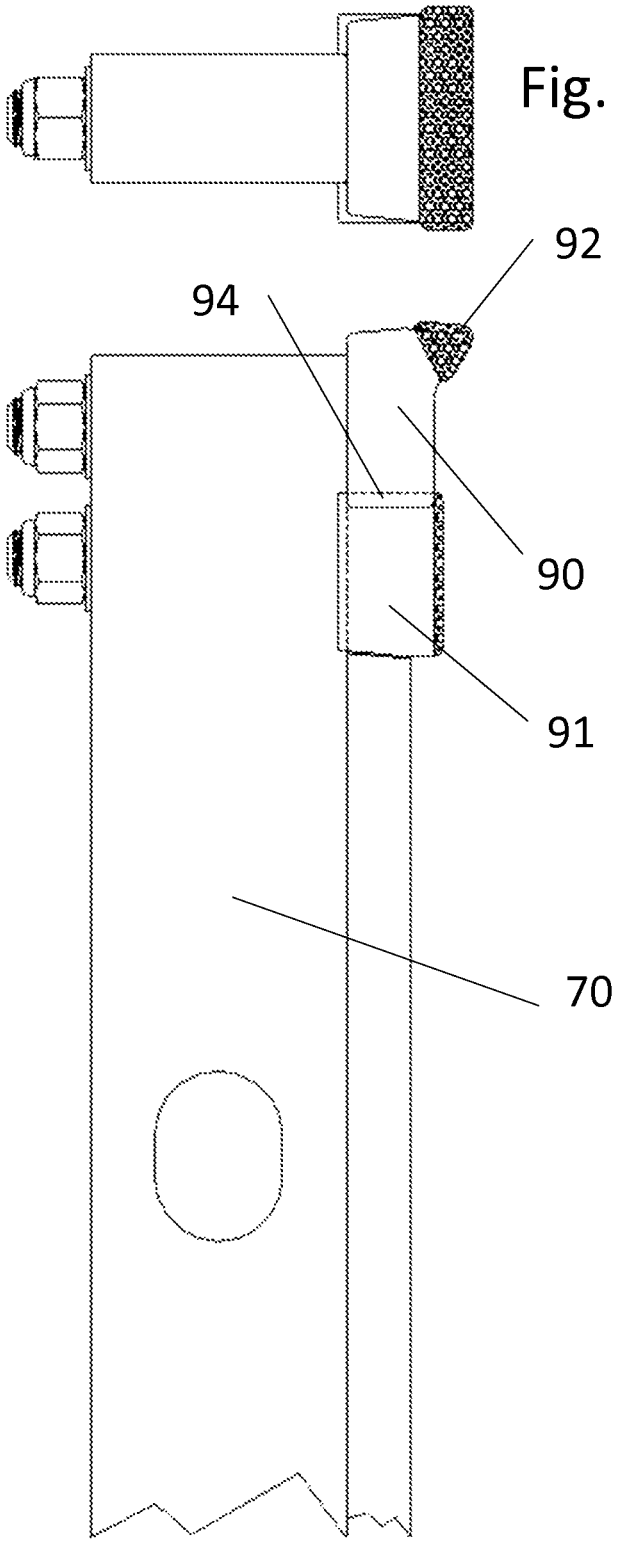
Fig. 9a
Fig. 9c
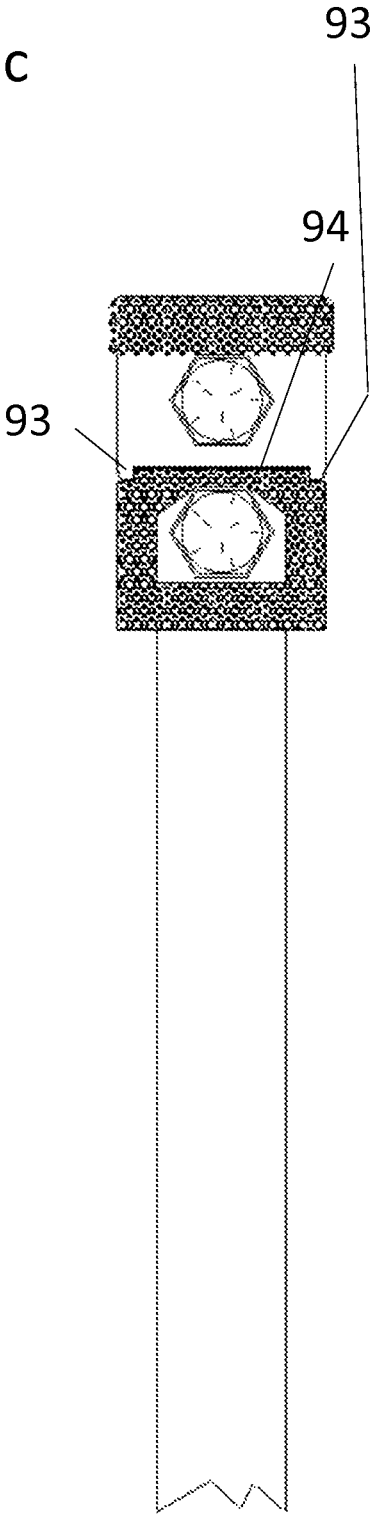
Fig. 9b

Fig. 10c
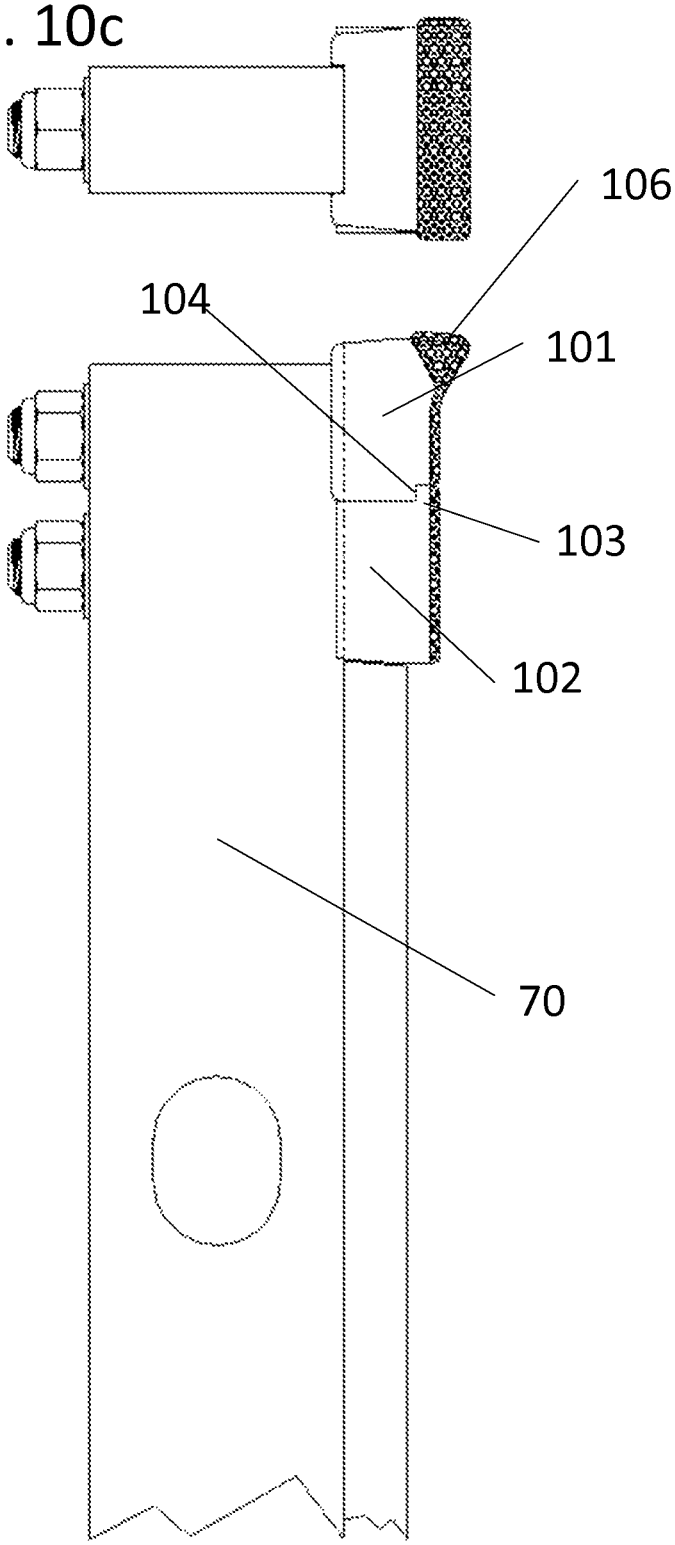
Fig. 10a
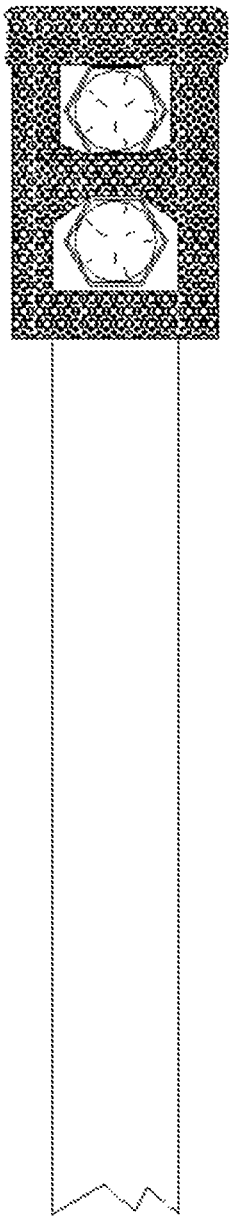
Fig. 10b

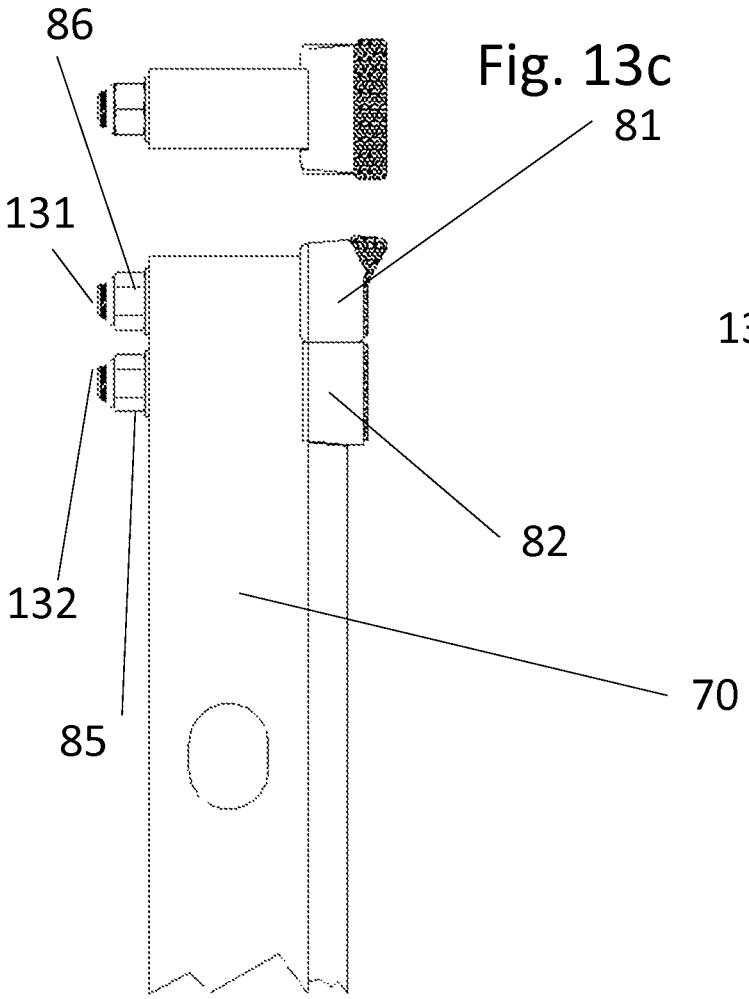
Fig. 13c
Fig. 13a
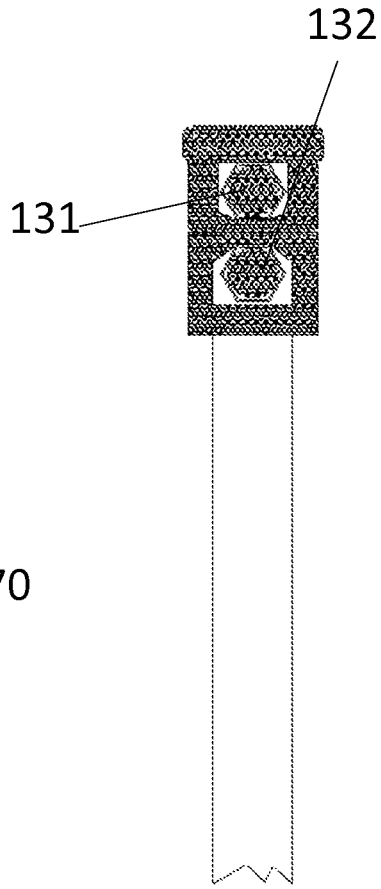
Fig. 13b

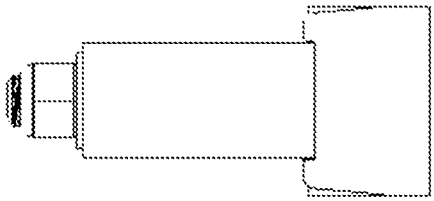
Fig. 15c
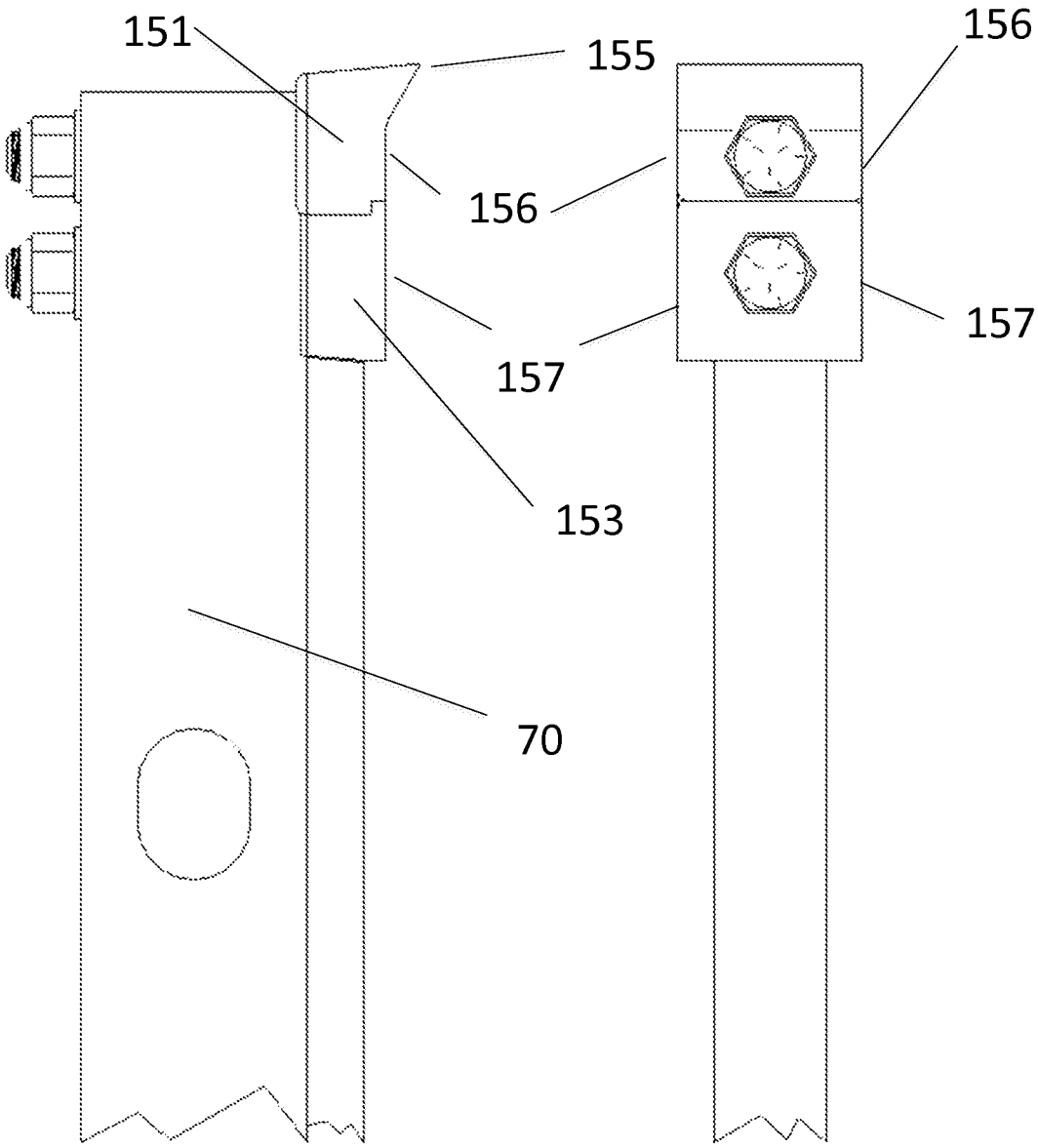
Fig. 15a
Fig. 15b

WINGED HAMMER TIP

CROSS-REFERENCE TO RELATED APPLICATIONS

This application is a continuation-in-part of U.S. patent application Ser. No. 14/708,945, filed May 11, 2015, and issued on Sep. 22, 2020 as U.S. Pat. No. 10,780,441, titled "Production Plus Hammer Tip," which claims the benefit of and priority to U.S. Provisional Patent Application No. 61/993,335, filed May 15, 2014, titled "Production Plus Hammer Tip," the contents of which are incorporated herein by reference.

FIELD OF INVENTION

The present invention relates to a hammer tip for releasable integration with a hammer, used in a size reducing machine.

BACKGROUND

Size reducing machines include rotary hammer mills, tub grinders, vertical and horizontal feed machines and the like. These machines include a plurality of hammers with replaceable hammer tips. Common design practice is for the hammer tips to be symmetrical with two top working edges. It is also common for the hammer tip to be attached to the hammer with two bolts and two nuts. U.S. Pat. No. 6,419,173 granted to Balvanz shows the symmetrical hammer tip and two bolt attachment.

One of the two hammer tip top working edges will encounter the brunt of the action and exhibit the most wear (the up position). The other symmetrical working edge is mostly out the action (the down position) and will exhibit only some wear.

Depending on the location of the hammer tip within the machine, it will exhibit more or less wear than other hammer tips.

During hammermill operation, it is important that the hammer tips are not too worn. Excessively worn hammer tips will reduce the mill operation throughput and increase the machine power consumption. Typically, the hammermill operator will inspect the hammermill tips for wear every 4 hours or as scheduled.

If a hammermill tip top working edge is observed to be worn, the two attachment bolts are removed. Typically in extreme conditions, both bolt heads are also worn and the bolts will be replaced. If both working edges of the hammermill tip are worn, the hammermill tip is replaced. If only one of the hammermill tips is worn, the hammermill tip is rotated end for end and reinstalled.

Because there are twice as many working edges (both ends of each hammer tip) compared to the number of hammers, the operator may try to overly optimize the position of the working edges. This repositioning of the working edges causes excessive downtime.

SUMMARY OF THE INVENTION

The present invention is a hammer tip comprised of two sections. The production block is the upper portion of the hammer tip and includes the top working edge. The spacer block fills the space below the production block and secures the production block positioning. The spacer block also provides additional side working edges and flat front surface with carbide facing. In one embodiment, the spacer block further includes a pair of wings extending outwardly from the left and right sides, and forwardly from the front side, of the spacer block to form additional cutting edges and to provide more surface area. In this manner, the wings provide for additional sizing of the material being ground and help move (or push or carry) more material through the grates of the size reducing machine. This results in improved efficiency.

The maximum amount of working edge (top and side) and flat impact face of the production block is desirable for grinding throughput.

One of the objects of the invention is to have a single top working edge for each hammer tip. This simplifies the replacement procedure and eliminates downtime due to excessive repositioning of hammer tips. Replacement of production blocks requires 50% less downtime due to only a single bolt removal. For reassembly, the production block is placed on top of the spacer block. This positioning guide decreases the downtime in lining up the production block and bolt.

Another object of the invention is to increase the throughput of the size reducing machine by increasing the amount of working edge. In addition to the top working edge, there are also side working edges. The spacer block includes two full length side working edges. This is substantially more side working edge compared to a symmetrical hammer tip with two top working edges. The spacer block provides a full flat face that could be fully covered with a wear resistant coating such as Caden Edge. This increase in carbide covered flat face also increases throughput. As previously noted, in one embodiment, the spacer block further includes a pair of wings extending outwardly from the left and right sides, and forwardly from the front side, of the spacer block to form additional cutting edges and to create more surface area. In this manner, the wings provide for additional sizing of the material being ground and help move (or push or carry) more material through the grates of the size reducing machine.

Another object of the invention is to reduce the amount of high-grade steel material. It is anticipated that the production block would need replacing approximately 10 times before the spacer block would need replacement. By replacing only the worn production block most of the time, a large savings in total usage of high-grade steel material is realized. Two production blocks will last substantially longer in machine use than one symmetrical hammer tip. This is because the lower half of the symmetrical hammer tip is partially worn before it is inverted and reinstalled.

Another object of the invention is to reduce the number of replacement bolts and nuts. In one configuration of the invention, the nuts are eliminated with internal threads on the production block or spacer block. In another configuration, the bolt head is protected in the production block or spacer block with a wear resistant coating.

In another configuration of the invention, a saddle back shoulder is used to resist movement of the production block or spacer block relative to the hammer. This saddle back is important for secure attachment of these parts with a single bolt.

In another configuration of the invention, a locking ledge is used between the production plus block and support block.

DETAILED DESCRIPTION OF THE DRAWINGS

FIG. 1 is a prior art side view of a grinding machine assembly.

Figure 2B:
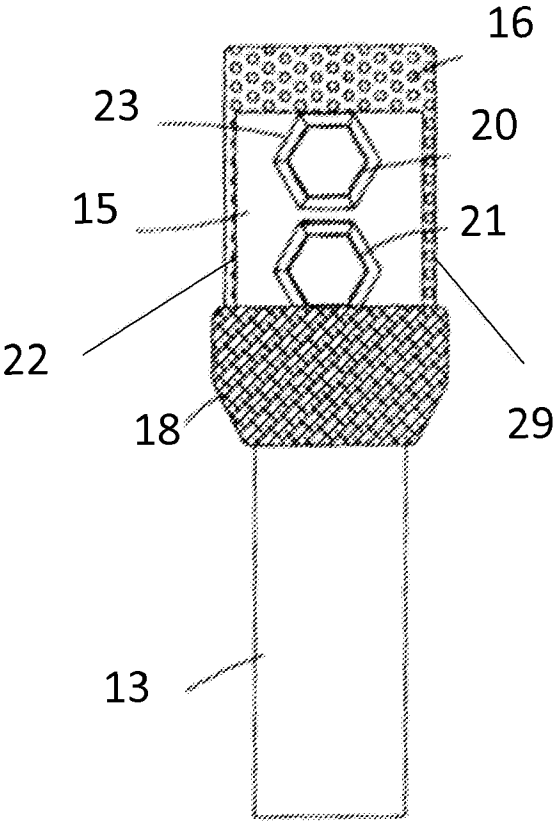
Prior Art Fig. 2b
Figure 2A:
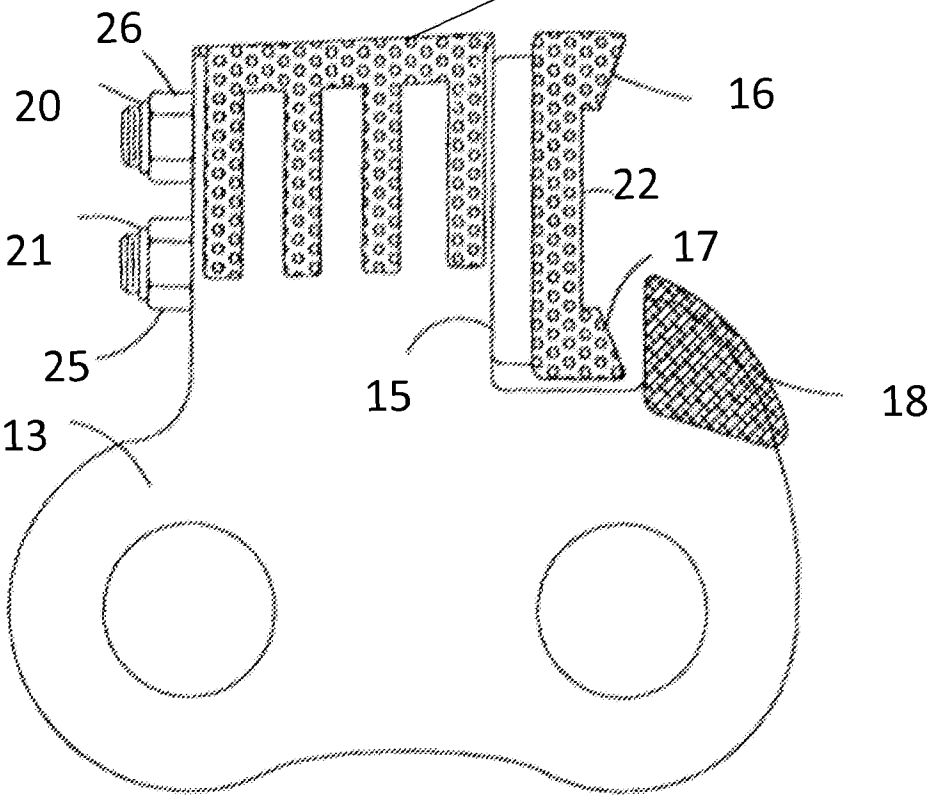
Prior Art Fig. 2a

FIG. 2*a* is a prior art front view of a hammer assembly.

FIG. 2*b* is a prior art front view of a hammer assembly.

Figures 3A, 3B, 3C:
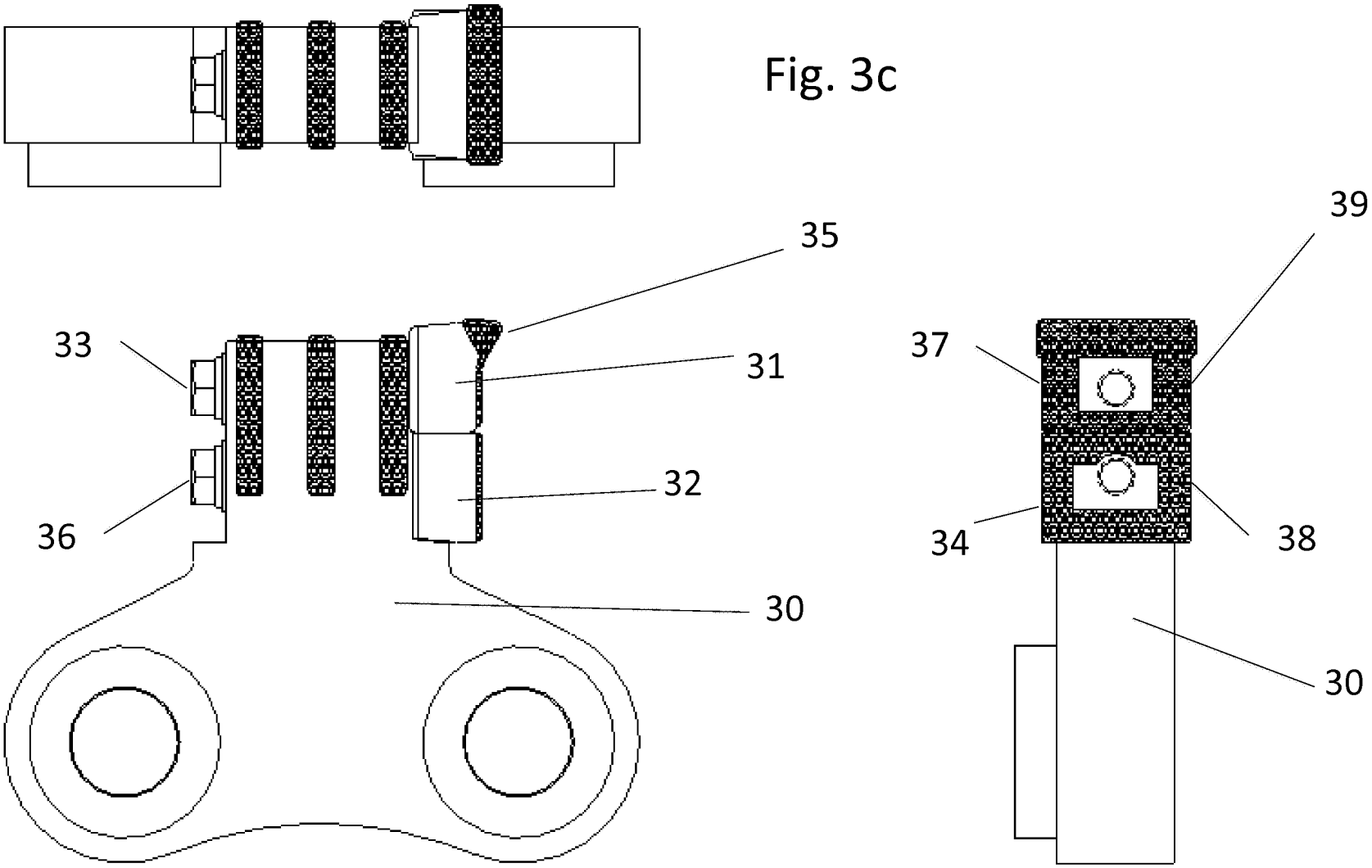

FIG. 3*a* is a side view of a production plus hammer assembly with bolts.

FIG. 3*b* is a front view of a production plus hammer assembly with bolts.

FIG. 3*c* is a top view of a production plus hammer assembly with bolts.

Figure 4B:
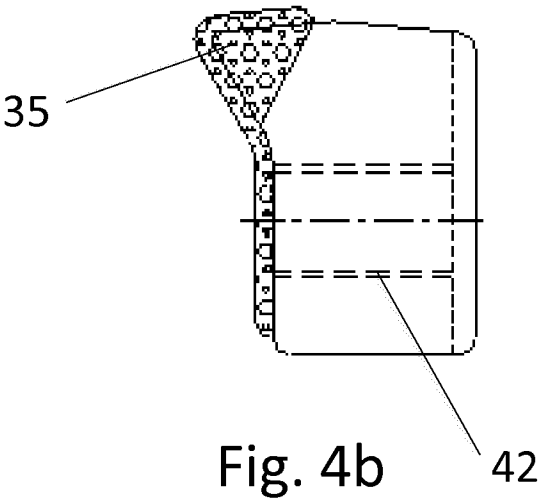
Figure 4A:
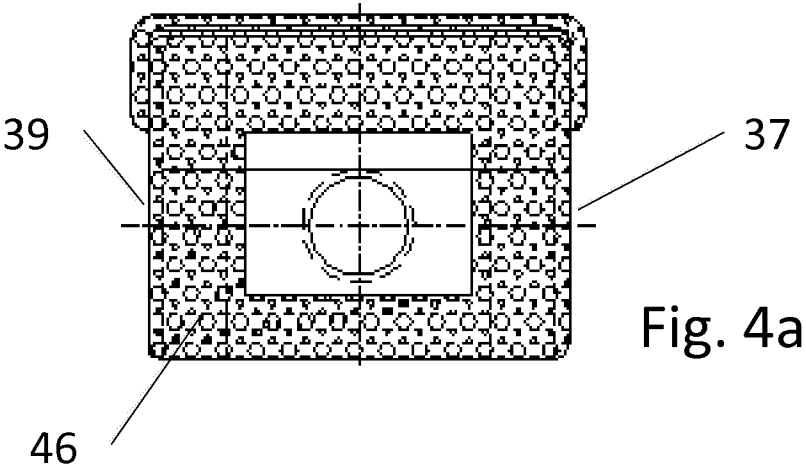

FIG. 4*a* is a front view of a production block with saddle back.

FIG. 4*b* is a side view of a production block with saddle back.

Figure 4C:
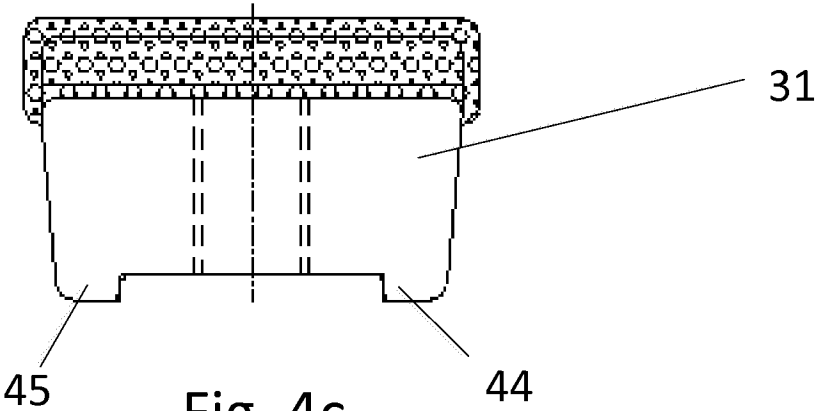

FIG. 4*c* is a bottom view of a production block with saddle back.

Figure 5B:
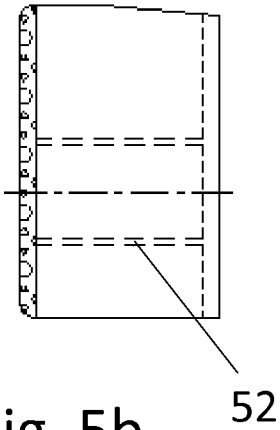
Figure 5A:
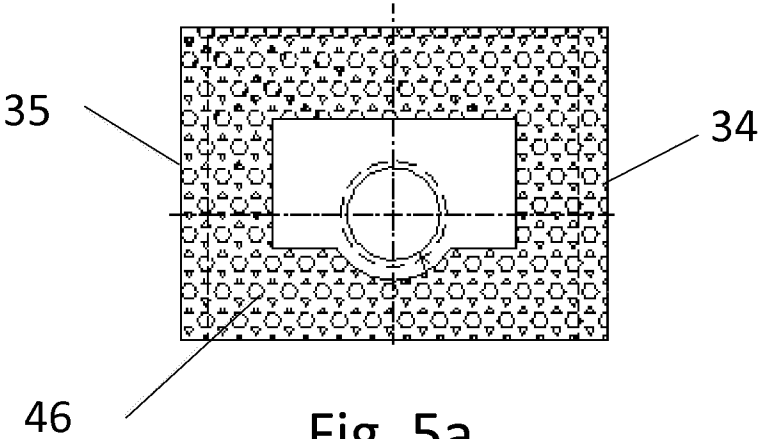

FIG. 5*a* is a front view of a spacer block with saddle back.

FIG. 5*b* is a side view of a spacer block with saddle back.

Figure 5C:
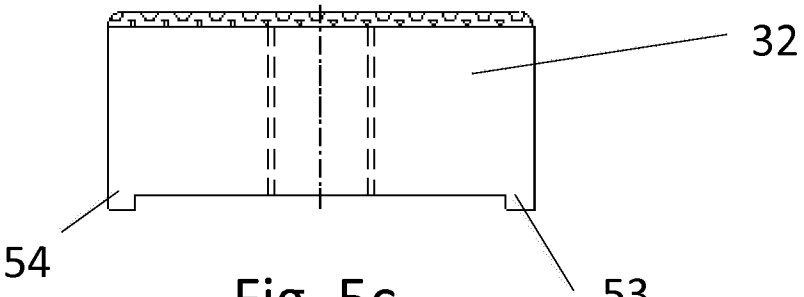

FIG. 5*c* is a top view of a spacer block with saddle back.

FIG. 6*a* is a side view of a production plus hammer assembly with nuts.

FIG. 6*b* is a front view of a production plus hammer assembly with nuts.

FIG. 6*c* is a top view of a production plus hammer assembly nuts.

FIG. 7*a* is a side view of a production plus bar hammer assembly with bolts.

FIG. 7*b* is a front view of a production plus bar hammer assembly with bolts.

FIG. 7*c* is a top view of a production plus bar hammer assembly with bolts.

Figure 8C:
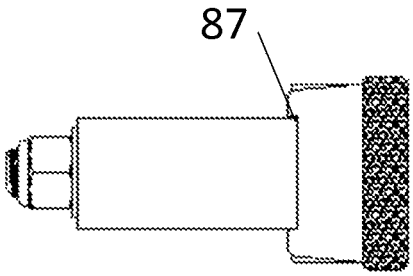
Figure 8A:
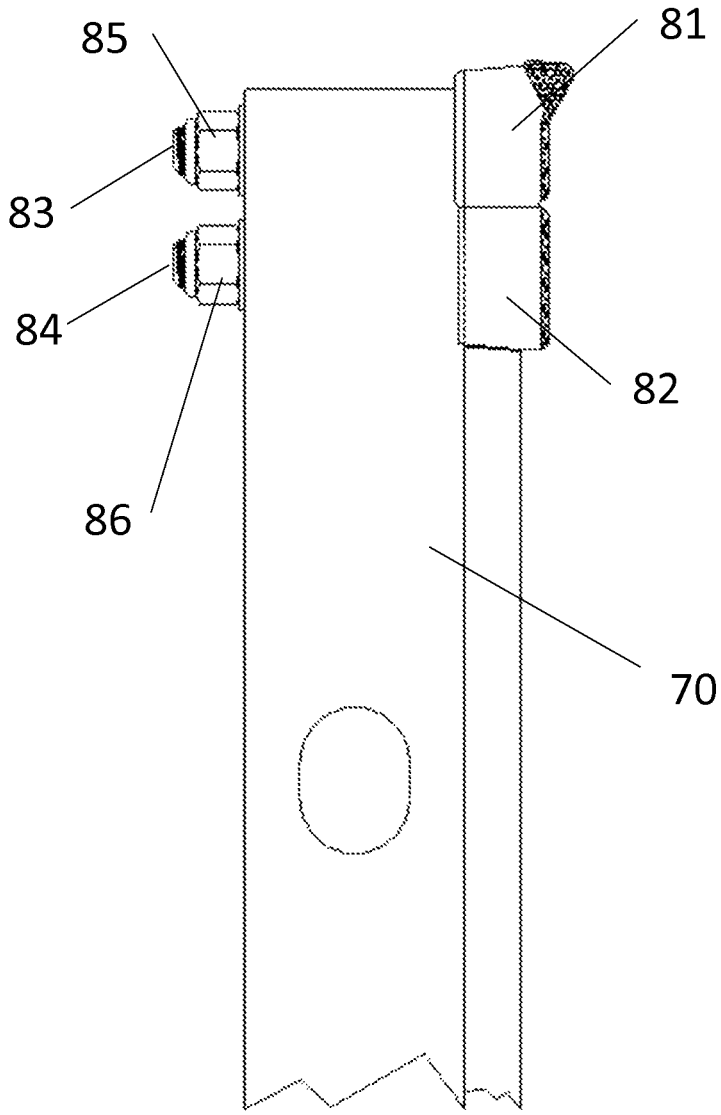

FIG. 8*a* is a side view of a production plus bar hammer assembly with nuts.

Figure 8B:
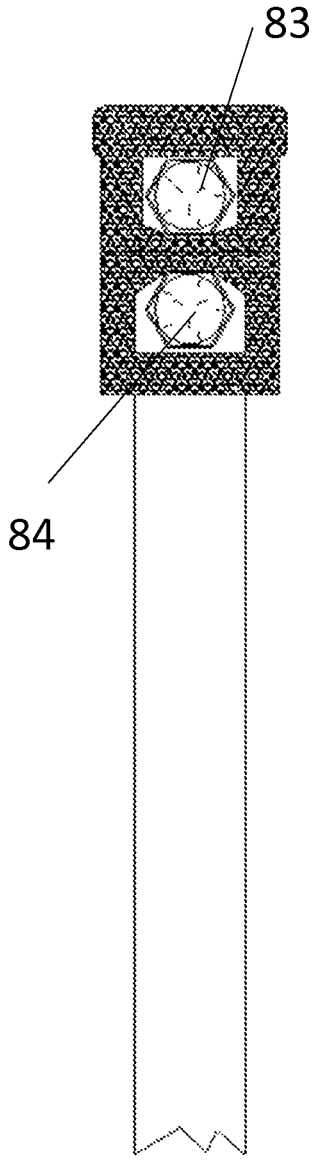

FIG. 8*b* is a front view of a production plus bar hammer assembly with nuts.

FIG. 8*c* is a top view of a production plus bar hammer assembly with nuts.

FIG. 9*a* is a side view of a production plus bar hammer assembly with side saddle.

FIG. 9*b* is a front view of a production plus bar hammer assembly with side saddle.

FIG. 9*c* is a top view of a production plus bar hammer assembly with side saddle.

FIG. 10*a* is a side view of a production plus bar hammer assembly with lock ledge.

FIG. 10*b* is a front view of a production plus bar hammer assembly with lock ledge.

FIG. 10*c* is a top view of a production plus bar hammer assembly with lock ledge.

Figure 11A:
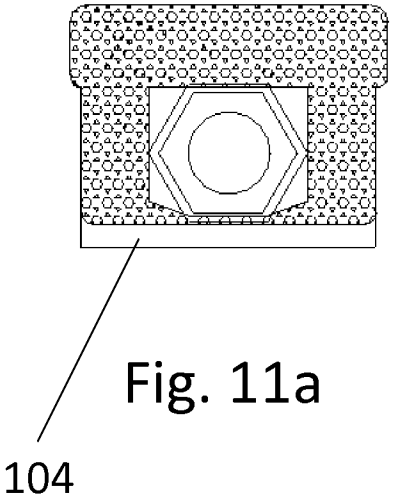

FIG. 11*a* is a front view of a production block with lock pocket.

Figure 11B:
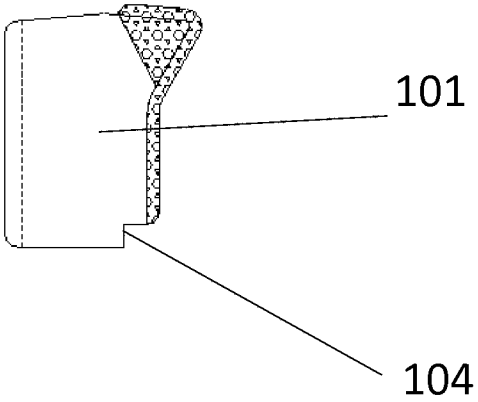

FIG. 11*b* is a side view of a production block with lock pocket.

Figure 11C:
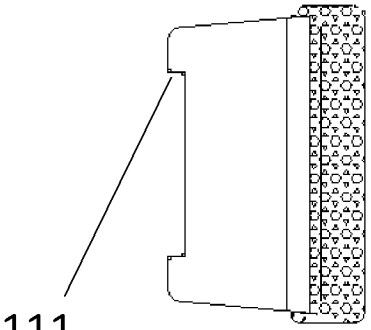

FIG. 11*c* is a bottom view of a production block with lock pocket.

Figure 12A:
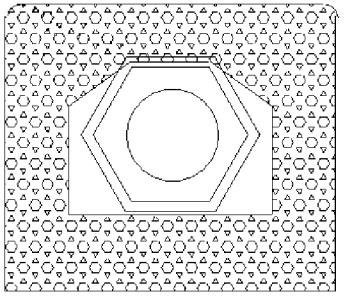

FIG. 12*a* is a front view of a spacer block with lock ledge.

Figure 12B:
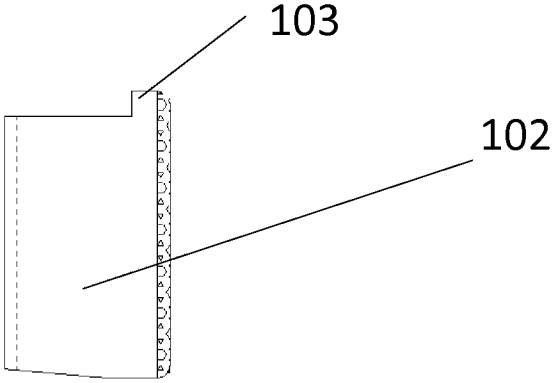

FIG. 12*b* is a side view of a spacer block with lock ledge.

Figure 12C:
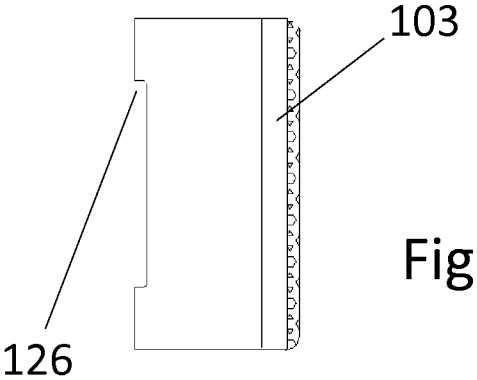

FIG. 12*c* is a top view of a spacer block with lock ledge.

FIG. 13*a* is a side view of a production plus bar hammer assembly with Caden Edge bolt head.

FIG. 13*b* is a front view of a production plus bar hammer assembly with Caden Edge bolt head.

FIG. 13*c* is a top view of a production plus bar hammer assembly with Caden Edge bolt head.

Figure 14:
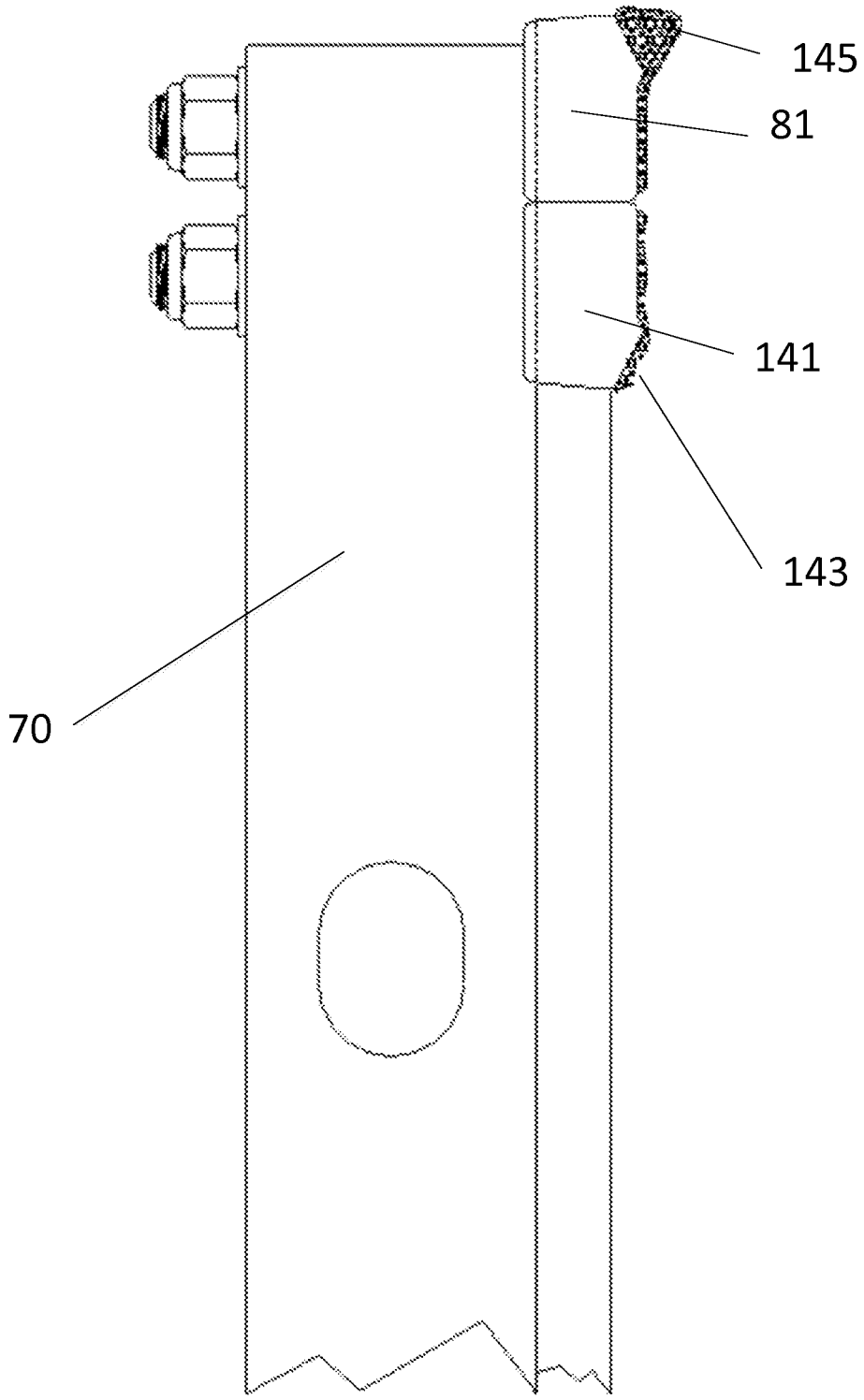

FIG. 14 is a side view of a production plus bar hammer assembly with worn production spacer.

FIG. 15*a* is a side view of a production plus bar hammer assembly with sharp edge. FIG. 15*b* is a front view of a production plus bar hammer assembly with sharp edge.

FIG. 15*c* is a top view of a production plus bar hammer assembly with sharp edge.

Figure 16B:
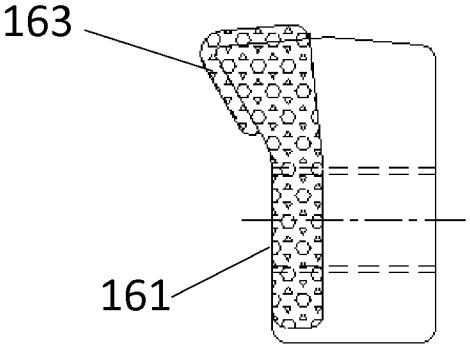
Figure 16A:
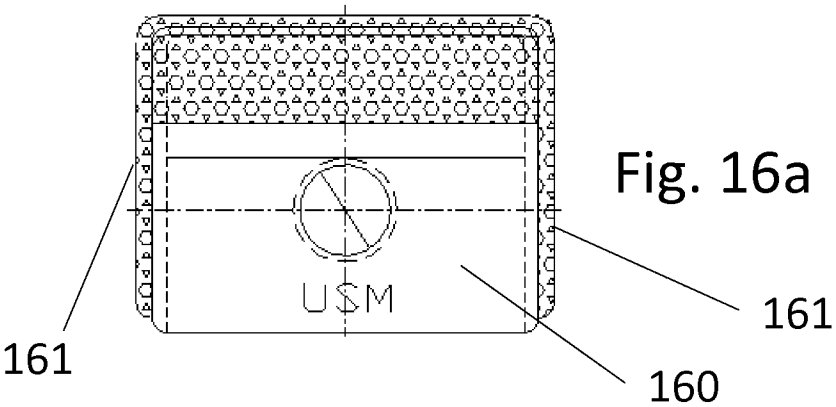

FIG. 16*a* is a front view of a production block with side Caden Edge.

FIG. 16*b* is a side view of a production block with side Caden Edge.

Figure 16C:
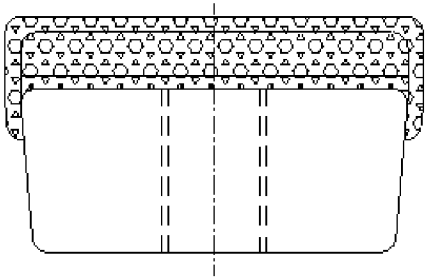

FIG. 16*c* is a bottom view of a production block with side Caden Edge.

Figure 17B:
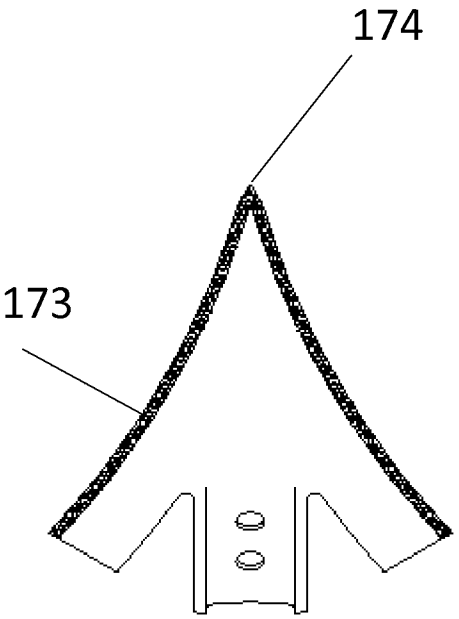
Figure 17A:
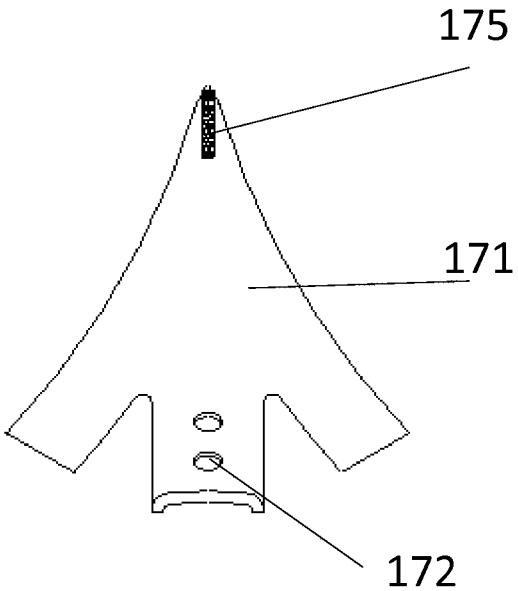

FIG. 17*a* is a top view of a sweep with nose point Caden Edge.

FIG. 17*b* is a bottom view of a sweep with nose point Caden Edge.

Figure 18C:
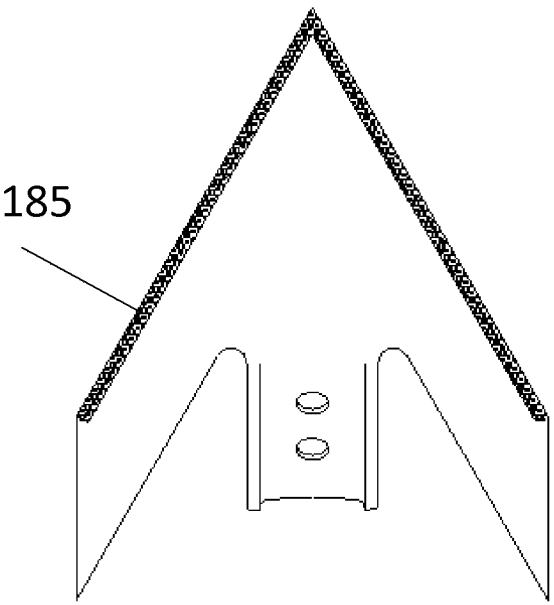
Figure 18B:
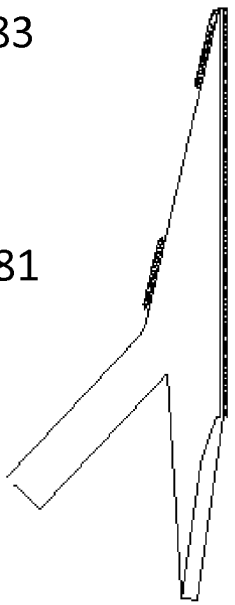
Figure 18A:
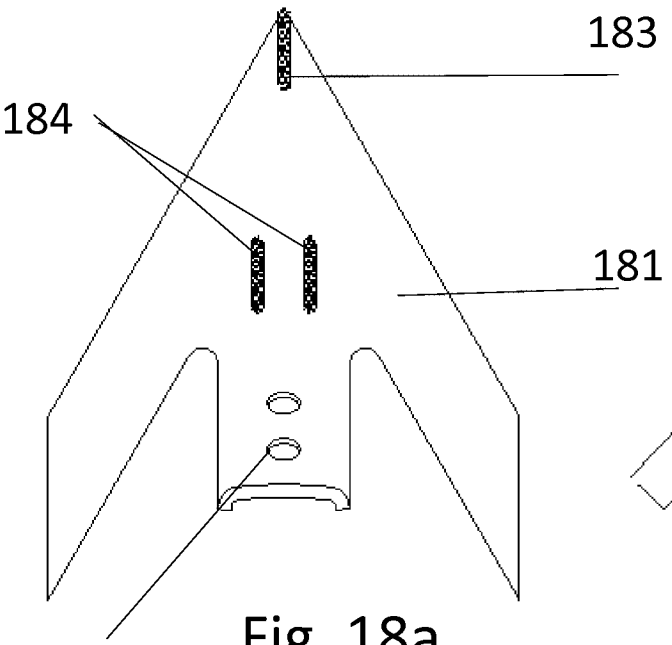

FIG. 18*a* is a top view of a sweep with nose point and heel Caden Edge.

FIG. 18*b* is a side view of a sweep with nose point and heel Caden Edge.

FIG. 18*c* is a bottom view of a sweep with nose point and heel Caden Edge.

Figure 19A:
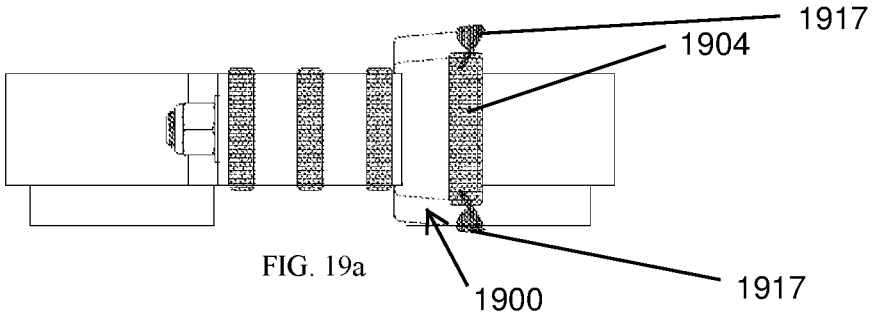

FIG. 19*a* is a top view of a hammer assembly with winged hammer tip according to an alternate embodiment of the present invention.

Figure 19B:
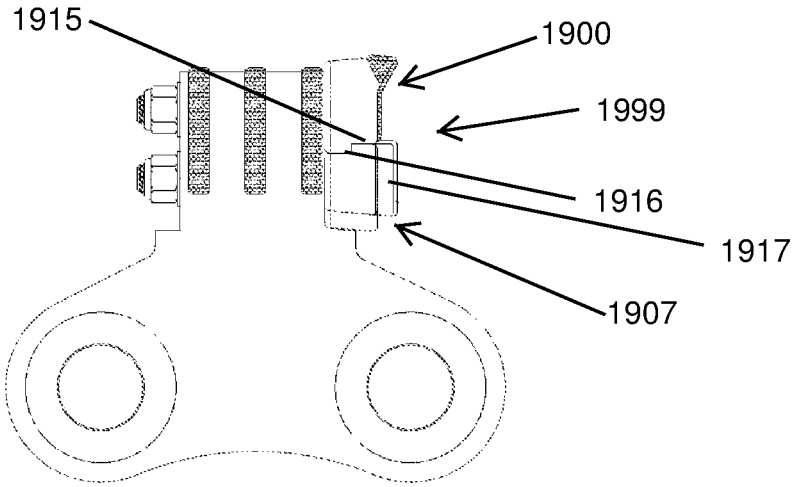

FIG. 19*b* is a side view of a hammer assembly with winged hammer tip according to an alternate embodiment of the present invention.

Figure 19C:
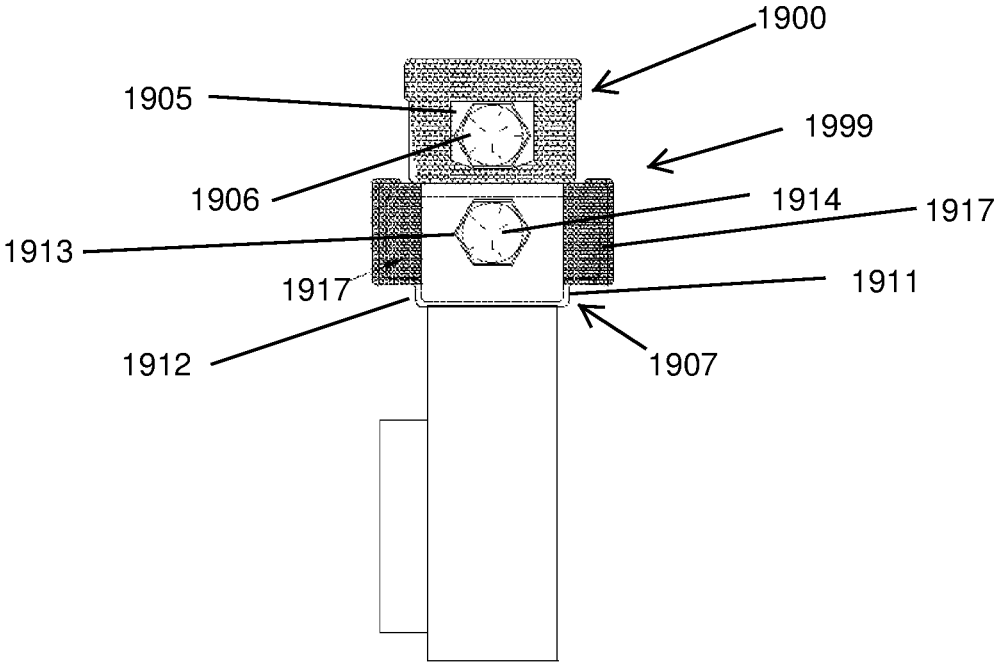

FIG. 19*c* is a front view of hammer assembly with winged hammer tip according to an alternate embodiment of the present invention.

Figure 20A:
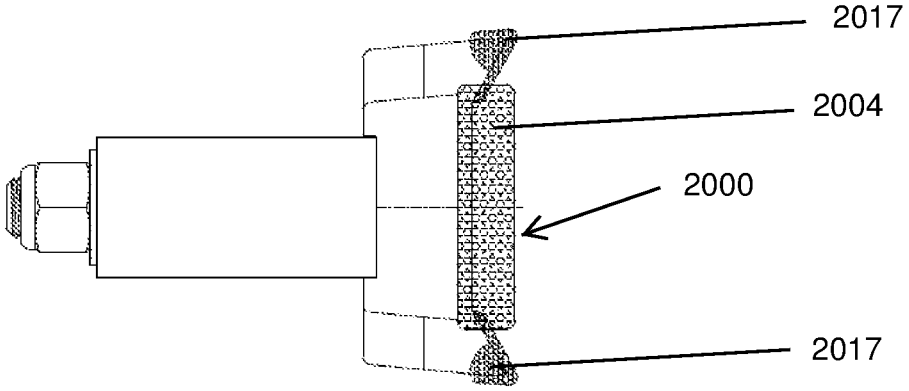

FIG. 20*a* is a top view of a bar hammer assembly with winged hammer tip according to an alternate embodiment of the present invention.

Figure 20B:
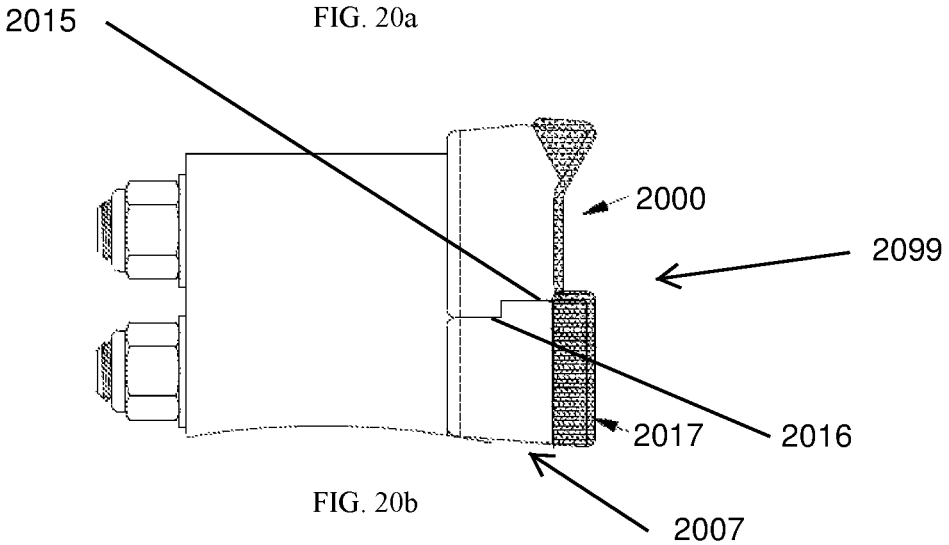

FIG. 20*b* is a side view of a bar hammer assembly with winged hammer tip according to an alternate embodiment of the present invention.

Figure 20C:
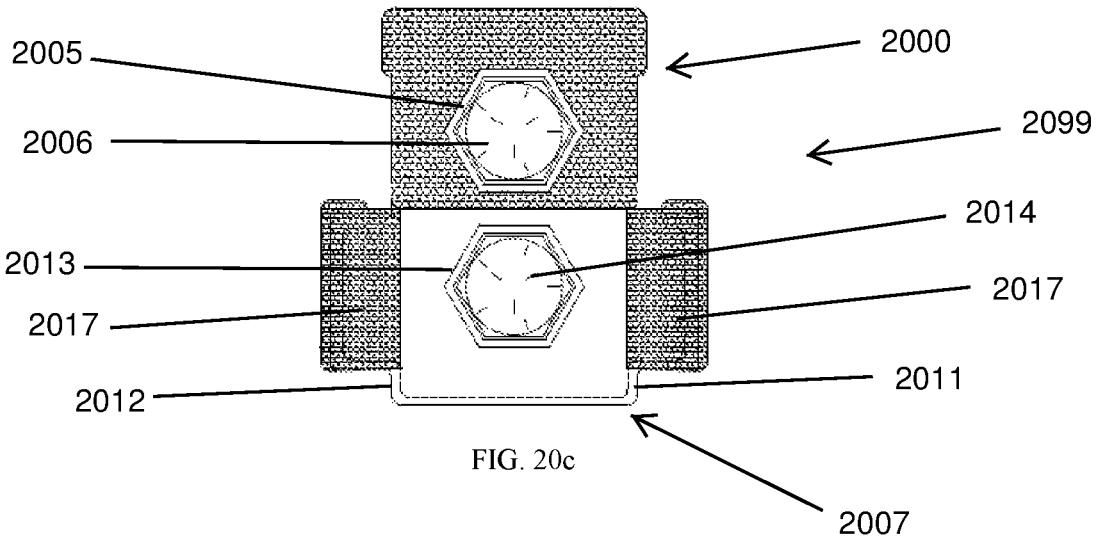

FIG. 20*c* is a front view of a bar hammer with winged hammer tip according to an alternate embodiment of the present invention.

REFERENCE NUMERALS

| | |
|---|---|
| 10 grinder housing | 11 drum |
| 12 rotation direction | 13 hammer |
| 15 hammer tip | 16 distal working edge |
| 17 distal working edge | 18 nose |
| 20 bolt | 21 bolt |
| 22 proximal working edge | 23 bolt pocket |
| 25 nut | 26 nut |
| 28 wear resistant surface | 29 proximal working edge |
| 30 hammer | 31 production block |
| 32 support block | 33 bolt |
| 34 side working edge | 35 top working edge |
| 37 side working edge | 38 side working edge |
| 39 side working edge | 42 internal thread |
| 44 saddle back | 45 saddle back |
| 46 wear resistant surface | 52 internal thread |
| 53 saddle back | 54 saddle back |
| 61 production block | 62 spacer block |
| 63 bolt | 64 bolt |
| 65 nut | 66 nut |
| 70 bar hammer | 71 production block |
| 72 spacer block | 73 bolt |
| 74 bolt | 75 internal thread |
| 76 saddle back | 81 production block |
| 82 spacer block | 83 bolt |
| 85 nut | 86 nut |
| 87 saddle back | 90 production block |
| 91 spacer block | 92 top working edge |
| 93 side saddle back | 94 saddle |
| 101 production block | 102 spacer block |
| 103 lock ledge | 104 lock pocket |
| 111 saddle back | 126 saddle back |
| 131 bolt | 132 bolt |
| 141 worn production block | 143 worn top working edge |

-continued

| REFERENCE NUMERALS | |
|---|---|
| 145 top working edge | 151 sharp edge production block |
| 153 sharp edge spacer block | 155 top working edge |
| 156 side working edge | 157 side working edge |
| 160 production block | 161 side working edge |
| 163 top working edge | 171 sweep |
| 172 sweep attachment | 173 bottom Caden Edge |
| 174 nose | 175 nose Caden Edge |
| 181 sweep | 182 sweep attachment |
| 183 nose Caden Edge | 184 shank Caden Edge |
| 185 bottom Caden Edge | 1900 production block |
| 1904 top working edge | 1905 opening |
| 1906 bolt | 1907 spacer block |
| 1911 left side of spacer block | 1912 right side of spacer block |
| 1913 opening | 1914 bolt |
| 1915 lock pocket | 1916 lock ledge |
| 1917 wings | 1999 winged hammer tip |
| 2000 production block | 2004 top working edge |
| 2005 opening | 2006 bolt |
| 2007 spacer block | 2011 left side of spacer block |
| 2012 right side of spacer block | 2013 opening |
| 2014 bolt | 2015 lock pocket |
| 2016 lock ledge | 2017 wings |
| 2099 winged hammer tip | |

DETAILED DESCRIPTION

FIG. 1 is a prior art side view of a grinding machine assembly. The grinder housing 10 is stationary. The drum 11 is powered and has rotation direction 12. The hammer 13 is affixed to the drum 11.

FIG. 2*a* is a prior art side view of a hammer assembly. The hammer tip 15 is affixed to the hammer 13 with bolt 21, bolt 20, nut 25 and nut 26. A bolt pocket 23 is incorporated into the hammer tip 15. The hammer tip 15 includes distal working edge 16, distal working edge 17, proximal working edge 22 and proximal working edge 29.

The nose 18 incorporated into the hammer 13 is intended to protect the distal working edge 17 from wear while in this position. After several hours of grinder operation, the distal working edge 16 would experience wear to the point that the grinder throughput is decreased. Then bolt 20 and bolt 21 would be removed, the hammer tip 15 would be inverted and the bolts replaced.

A wear resistant surface 28 such as Caden Edge is shown on the nose 18, hammer tip 15 and the top of the hammer 15.

FIG. 2*b* is a prior art front view of a hammer assembly. The working surfaces are all the rotating edges that provide grinding action. Note that as shown in FIG. 2*b*, the working surfaces include distal working edge 16 and approximately half of proximal working edge 22 and proximal working edge 29. The nose 18 is blunt and provides little working surface. The nose 18 also shields distal working edge 17 and approximately half of the proximal working edges.

FIG. 3*a* is a side view of a production plus hammer assembly with bolts. The hammer 30 no longer includes the nose 18 feature. The production plus hammer tip includes the production block 31 and the spacer block 32. The production plus hammer tip could be installed on the hammer 13, however the nose 18 would be vestigial feature.

The production block 31 and spacer block 32 are affixed to the hammer 30 with bolt 33 and bolt 36. The production block 31 and spacer block 32 include clearance holes for bolt 33 and bolt 36. Note how the surface plane between the production block 31 and spacer block 32 allow each of the blocks to provide support for the other.

FIG. 3*b* is a front view of a production plus hammer assembly with bolts. The production block 31 includes working surfaces top working edge 35, side working edge 37 and side working edge 39. The spacer block includes working surfaces side working edge 34 and side working edge 38. Note that all of side working edge 37 and side working edge 39 are working surfaces. Also note that a high percentage of side working edge 34 and side working edge 38 are working surfaces.

FIG. 4*a* is a front view of a production block with saddle back. A wear resistant surface 46 such as Caden Edge is shown on the top working edge 35, side working edge 39, side working edge 37 and all of the face except near the internal thread 42.

FIG. 4*b* is a side view of a production block with saddle back. The internal thread 42 is used by the bolt 33 to attach the production block 31 to the hammer 30.

FIG. 4*c* is a bottom view of a production block with saddle back. The saddle back 44 and saddle back 45 provide rotation resistance of the production block relative to the hammer 30.

FIG. 5*a* is a front view of a spacer block with saddle back. A wear resistant surface 46 such as Caden Edge is shown on the side working edge 35, side working edge 34 and all of the face except near the internal thread 52.

FIG. 5*b* is a side view of a spacer block with saddle back. The internal thread 52 is used by the bolt 36 to attach the spacer block 32 to the hammer 30.

FIG. 5*c* is a top view of a spacer block with saddle back. The saddle back 54 and saddle back 53 provide rotation resistance of the spacer block relative to the hammer 30.

FIG. 6*a* is a side view of a production plus hammer assembly with nuts. The production plus hammer tip includes the production block 61 and the spacer block 62. The production block 61 is affixed to the hammer 30 with bolt 63 and nut 65. The spacer block 62 is affixed to the hammer 30 with bolt 64 and nut 66.

FIG. 6*b* is a front view of a production plus hammer assembly with nuts. The production block would include a feature such as bolt pocket 23 to prevent rotation of bolt 63. The spacer block 62 would include a feature such as bolt pocket 23 to prevent rotation of bolt 64.

FIG. 7*a* is a side view of a production plus bar hammer assembly with bolts. The bar hammer 70 provides a similar function to the hammer 30. The bar hammer 70 is affixed to a drum 11 and provides attachment means for the production plus hammer tip. The production block 71 and spacer block 72 are affixed to the bar hammer 70 with bolt 73 and bolt 74.

FIG. 8*a* is a side view of a production plus bar hammer assembly with nuts. The production block 81 is affixed to the bar hammer 70 with bolt 83 and nut 85. The spacer block 82 is affixed to the bar hammer 70 with bolt 84 and nut 86.

FIG. 9*a* is a side view of a production plus bar hammer assembly with side saddle. The spacer block 91 includes a saddle back feature with the bar hammer 70 to resist rotational movement. The spacer block 91 also includes a saddle 94 feature which protrudes above the upper surface.

FIG. 9*b* is a front view of a production plus bar hammer assembly with side saddle. The production block 90 includes two side saddle 93 features. These mate with the saddle 94 and resist rotational movement of the production block 90. As shown in FIG. 9*a*, the production block 90 does not include a saddle back feature, since rotational movement is covered by the side saddle.

FIG. 10*a* is a side view of a production plus bar hammer assembly with lock ledge, and FIGS. 10*b* and 10*c* are front and top views, respectively, of the production plus bar hammer assembly with lock ledge. In this configuration, both the production block 101 and spacer block 102 include saddle back features. In addition, the spacer block 102 includes a lock ledge 103. The production block 101 includes a lock pocket 104. The lock ledge 103 prevents tilting motion of the production block 101. This tilting motion is caused by the impact of grinding material against the top working edge 106.

FIG. 11*a* is a front view, and FIB. 11*b* is a side view, of a production block with lock pocket. The lock pocket 104 is recessed into the front of the production block along the width of the front side of the production block. The lock pocket 104 and lock ledge 103 are precision machined to tightly fit.

FIG. 11*c* a bottom view of a production block with lock pocket. Note the saddle back 111 on the back of the part.

FIG. 12*a* is a front view, and FIG. 12*b* is a side view, of a spacer block with lock ledge. The lock ledge 103 is formed as a ledge along the width of the back side of the spacer block and holds the bottom of the production block against the bar hammer 70.

FIG. 12*c* is a top view of a spacer block with lock ledge. Note the saddle back 126 on the back of the part.

FIG. 13*a* is a side view of a production plus bar hammer assembly with Caden Edge bolt head. This is similar construction to FIG. 8*a* with the exception of the bolts.

FIG. 13*b* is a front view of a production plus bar hammer assembly with Caden Edge bolt head. During operation, the impact of material on the production plus hammer tip causes wear on any forward-facing surface. The high impact surfaces of the production block 81 and spacer block 82 are covered with a wear resistant coating. As shown in FIG. 8*b*, the heads of bolt 83 and bolt 84 are subject to high wear. As shown in FIG. 13*b*, the heads of bolt 131 and bolt 132 are covered with a wear resistant coating such as Caden Edge.

In configuration A of FIG. 13*b* the head of bolt 131 would have the wear resistant coating applied before assembly to production block 81. This would keep the most flexibility in assembly/disassembly of the production block 81 to the bar hammer 70.

In configuration B of FIG. 13*b* the head of bolt 131 would have the wear resistant coating applied after assembly to production block 81. The application of the wear resistant coating such as Caden Edge would permanently capture the bolt 131 to the production block 81. The head of the bolt 131 would be welded to the bolt pocket 23 of the production block 81. It is important that the bolt 131 be accurately aligned with the production block 81 during the welding (Caden Edge) process to facility assembly to the bar hammer 70. It is possible with this configuration for the entire face (all front surface of production block 81 and bolt 131 head) to be covered with the wear resistant coating such as Caden Edge.

Configurations A or B would also have applicability to spacer block 82 and bolt 132.

FIG. 14 is a side view of a production plus bar hammer assembly with worn production spacer. A spacer block 62 will wear at about 1/10 the rate of the production block 81. In a production environment, there will be an excess of worn production blocks 141. With the correct geometry, it is possible to allow worn production blocks 141 to be used as replacement spacer blocks 62. The worn production block 141 is rotated and placed with the worn top working edge 143 at the bottom.

The correct geometry includes:

a. not having the lock ledge feature b. not having the side saddle feature and c. both blocks having the same distance from bolt centerline to production block/spacer block contact surface.

FIG. 15*a* is a side view of a production plus bar hammer assembly with sharp edge. The sharp edge production block 151 includes a top working edge 155 and two side working edges 156. The sharp edge spacer block 153 includes two side working edges 157. For good wear resistance, the working edges and front face of sharp edge production block 151 and sharp edge spacer block 153 could be hardened to approximately HRC 60. These blocks could also have a thin wear resistant coating of carbide spray applied.

FIG. 16*a* is a front view of a production block with side Caden Edge. The production block 160 includes wear resistant coating such as Caden Edge on the top working edge 163 and two side working edges 161.

Pat. Appl. Pub. No. 2013/0252023 Caden Edge Welding Process shows the Caden Edge weld being applied to the bottom surface of a plow sweep blade. In combination with this bottom surface Caden Edge weld, it also enhances the wear life of the plow sweep blade to apply a Caden Edge weld to the nose tip. FIG. 17*a* is a top view of a sweep with nose point Caden Edge. The sweep 171 is affixed to the implement via the sweep attachment 172. The bottom Caden Edge 173 is shown in FIG. 15*b*. The wear improvement is the nose Caden Edge 175.

A typical sweep 171 overall length is 7 to 24 inches from nose 174 to sweep attachment 172. The nose Caden Edge would be approximately 1 to 3 inches in length from the nose 174 to the weld end.

FIG. 18*a* is a top view of a sweep with nose point and heel Caden Edge. The sweep 181 includes bottom Caden Edge 185, nose Caden Edge 183 and one or more shank Caden Edges 184. In this configuration, it is desired to reduce the wear on the sweep shank area. The shank Caden Edge 184 would be approximately 1 to 3 inches in length and positioned between the nose Caden Edge 183 and the sweep attachment 182.

In another embodiment of the hammer tip, as shown in FIGS. 19*a*-19*c* and 20*a*-20*c*, the spacer block as previously disclosed, described and shown herein may further include a pair of wings extending outwardly from the left and right sides, and forwardly from the front side, of the spacer block to form additional cutting edges. In this manner, the wings provide for additional sizing of the material being ground and provide additional surface area to help move (or push or carry) more material through the grates of the size reducing machine. Such increased material flow increases efficiency of the size reducing process by pushing or carrying more material through the grates and into the conveyor in the same amount of time (as compared to a spacer block without wings). This embodiment of the hammer tip is referred to herein as the winged hammer tip. The winged hammer tip includes many of the features of the production block and spacer block as shown in FIGS. 11*a*-*c* and 12*a*-*c* and as described above, which will not be repeated here in their entirety but which are incorporated by reference.

FIG. 19*a* is a top view, FIG. 19*b* is a side view and FIG. 19*c* is a front view of a hammer assembly with a winged hammer tip 1999, the winged hammer tip having a production block 1900 and a spacer block 1907. As shown in FIGS. 19*a*-19*c*, production block 1900 comprises a body having a front side, a back side, a top working edge 1904 and an opening 1905 formed in the body and extending between the front side of the production block 1900 and the back side of the production block 1900, the opening 1905 configured to receive a bolt 1906 to attach the production block 1900 to the hammer.

The spacer block 1907 comprises a body having a front side, a back side, a left side 1911, a right side 1912 and an opening 1913 formed in the body and extending between the front side of the spacer block 1907 and the back side of the spacer block 1907, the opening 1913 configured to receive a bolt 1914 to attach the spacer block 1907 to the hammer.

The production block 1900 and the spacer block 1907 each comprise a saddle back formed on their respective back sides and configured to engage with the hammer for releasable attachment thereto as described herein with respect to other embodiments. Also as described herein with respect to other embodiments of the production block and spacer block, the production block 1900 further comprises a lock pocket 1915, the lock pocket 1915 formed as a recess along a width of the front side of the production block 1900, and the spacer block 1907 comprises a lock ledge 1916, the lock ledge 1916 formed as a ledge along a width of the back side of the spacer block 1907. In this manner, the lock pocket 1915 of the production block 1900 is configured to matingly engage with the lock ledge 1916 of the spacer block 1907 when the production block 1900 and spacer block 1907 are attached to the hammer to hold the production block 1907 against the hammer and to prevent the production block 1907 from tilting away from the hammer when the top working edge 1904 of the production block 1907 is impacted by a grinding material.

In this embodiment of winged hammer tip 1999, the spacer block 1907 further comprises a pair of side working edges, the side working edges formed as a pair of wings 1917 extending outwardly from the left side 1911 and right side 1912, respectively, of the spacer block and forwardly from the front side of the spacer block. As discussed above, wings 1917 provide for additional sizing of the material being ground and help move (or push or carry) more material through the grates of the size reducing machine and into the conveyor in the same amount of time (as compared to spacer blocks without wings). This increased throughput improves efficiency of the size reducing machine. In some embodiments, wings 1917 may be partially, or substantially entirely, coated with a wear resistant coating to improve durability.

FIG. 20*a* is a top view, FIG. 20*b* is a side view and FIG. 20*c* is a front view of a bar hammer assembly with a winged hammer tip 2099, the winged hammer tip having a production block 2000 and a spacer block 2007. As shown in FIGS. 20*a*-20*c*, production block 2000 comprises a body having a front side, a back side, a top working edge 2004 and an opening 2005 formed in the body and extending between the front side of the production block 2000 and the back side of the production block 2000, the opening 2005 configured to receive a bolt 2006 to attach the production block 2000 to the hammer.

The spacer block 2007 comprises a body having a front side, a back side, a left side 2011, a right side 2012 and an opening 2013 formed in the body and extending between the front side of the spacer block 2007 and the back side of the spacer block 2007, the opening 2013 configured to receive a bolt 2014 to attach the spacer block 2007 to the hammer.

The production block 2000 and the spacer block 2007 each comprise a saddle back formed on their respective back sides and configured to engage with the hammer for releasable attachment thereto as described herein with respect to other embodiments. Also as described herein with respect to other embodiments of the production block and spacer block, the production block 2000 further comprises a lock pocket 2015, the lock pocket 2015 formed as a recess along a width of the front side of the production block 2000, and the spacer block 2007 comprises a lock ledge 2016, the lock ledge 2016 formed as a ledge along a width of the back side of the spacer block 2007. In this manner, the lock pocket 2015 of the production block 2000 is configured to matingly engage with the lock ledge 2016 of the spacer block 2007 when the production block 2000 and spacer block 2007 are attached to the hammer to hold the production block 2007 against the hammer and to prevent the production block 2007 from tilting away from the hammer when the top working edge 2004 of the production block 2007 is impacted by a grinding material.

In this embodiment of winged hammer tip 2099, the spacer block 2007 further comprises a pair of side working edges, the side working edges formed as a pair of wings 2017 extending outwardly from the left side 2011 and right side 2012, respectively, of the spacer block and forwardly from the front side of the spacer block. As discussed above, wings 2017 provide for additional sizing of the material being ground and help move (or push or carry) more material through the grates of the size reducing machine and into the conveyor in the same amount of time (as compared to spacer blocks without wings). This increased throughput improves efficiency of the size reducing machine. In some embodiments, wings 2017 may be partially, or substantially entirely, coated with a wear resistant coating to improve durability.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawings and description in this disclosure are provided to help the reader understand the invention, and do not limit the scope of the claims.

What is claimed is:

1. A winged hammer tip, the winged hammer tip comprising:

a production block comprising a body having a front side, a back side, a top working edge and an opening formed in the body and extending between the front side of the production block and the back side of the production block, the opening configured to receive a first bolt to attach the production block to a hammer; and a spacer block comprising a body having a front side, a back side, a left side, a right side and an opening formed in the body and extending between the front side of the spacer block and the back side of the spacer block, the opening configured to receive a second bolt to attach the spacer block to the hammer, wherein the production block and the spacer block each comprise a saddle back formed on their respective back sides and configured to engage with a hammer for releasable attachment thereto, wherein the production block comprises a lock pocket, the lock pocket formed as a recess along a width of the front side of the production block, and the spacer block comprises a lock ledge, the lock ledge formed as a ledge along a width of the back side of the spacer block, wherein the lock pocket of the production block is configured to matingly engage with the lock ledge of the spacer block when the production block and spacer block are attached to the hammer to hold the production block against the hammer and to prevent the production block from tilting away from the hammer when the top working edge of the production block is impacted by a grinding material, and wherein the spacer block further comprises a pair of side working edges, the side working edges formed as a pair of wings extending outwardly from the left side and right side, respectively, of the spacer block forwardly from the front side of the spacer block.

2. The winged hammer tip of claim 1 wherein the top working edge of the production block includes a wear resistant coating.

3. The winged hammer tip of claim 1 wherein the top working edge of the production block is hardened.

4. The winged hammer tip of claim 1 wherein at least a portion of the front side of the production block includes a wear resistant coating.

5. The winged hammer tip of claim 1 wherein the front side of the production block is coated with a wear resistant coating.

6. The winged hammer tip of claim 1 wherein the production block further comprises a pair of side working edges, the side working edges each including a wear resistant coating.

7. The winged hammer tip of claim 1 wherein the production block further comprises a pair of side working edges, the side working edges each being hardened.

8. The winged hammer tip of claim 1 wherein at least a portion of the pair of wings of the spacer block includes a wear resistant coating.

9. The winged hammer tip of claim 1 wherein the pair of wings of the spacer block is coated with a wear resistant coating.

10. The winged hammer tip of claim 1 wherein the production block further comprises a pair of side working edges, and the top working edge and the side working edges of the production block include a wear resistant coating.

11. The winged hammer tip of claim 1 wherein at least a portion of the front side of the production block and at least a portion of the pair of wings of the spacer block each include a wear resistant coating.

12. The winged hammer tip of claim 1 wherein the front side of the production block and the pair of wings of the spacer block each is coated with a wear resistant coating.

* * * * *